US008598744B2

(12) United States Patent
Choi et al.

(10) Patent No.: US 8,598,744 B2
(45) Date of Patent: Dec. 3, 2013

(54) APPARATUS FOR TRANSMITTING AND RECEIVING WIRELESS ENERGY USING META-MATERIAL STRUCTURES HAVING NEGATIVE REFRACTIVE INDEX

(75) Inventors: Jae Won Choi, Seoul (KR); Chul Hun Seo, Seoul (KR); Eung Ju Kim, Gyunggi-do (KR); Jeong Hoon Kim, Seoul (KR); Kwang Du Lee, Gyunggi-do (KR); Sang Hoon Hwang, Seoul (KR); Jung Ho Yoon, Gyunggi-do (KR); Chul Gyun Park, Gyunggi-do (KR)

(73) Assignees: Samsung Electro-Mechanics Co., Ltd., Gyunggi-do (KR); Soongsil University Research Consortium Techno-Park, Seoul (KR)

( * ) Notice: Subject to any disclaimer, the term of this patent is extended or adjusted under 35 U.S.C. 154(b) by 652 days.

(21) Appl. No.: 12/870,670

(22) Filed: Aug. 27, 2010

(65) Prior Publication Data

US 2011/0267247 A1 Nov. 3, 2011

(30) Foreign Application Priority Data

Apr. 30, 2010 (KR) ..... 10-2010-0041050

(51) Int. Cl.

| | |
|---|---|
| ***H01F 27/42*** | (2006.01) |
| ***H01F 37/00*** | (2006.01) |
| ***H01F 38/00*** | (2006.01) |

(52) U.S. Cl.
USPC ..... 307/104

(58) Field of Classification Search
USPC ..... 307/104
See application file for complete search history.

(56) References Cited

U.S. PATENT DOCUMENTS

| | | | | |
|---|---|---|---|---|
| 2008/0024792 | A1* | 1/2008 | Pendry et al. | 356/602 |
| 2011/0133568 | A1* | 6/2011 | Wang et al. | 307/104 |
| 2011/0204891 | A1* | 8/2011 | Drake et al. | 324/309 |
| 2011/0266879 | A1* | 11/2011 | Kim et al. | 307/104 |

* cited by examiner

*Primary Examiner* — Carlos Amaya
(74) *Attorney, Agent, or Firm* — Ladas & Parry, LLP

(57) ABSTRACT

Disclosed herein is there is provided an apparatus for transmitting and receiving wireless energy using meta-material structures having a negative refractive index. The apparatus includes a wireless energy transmission unit and a wireless energy reception unit. The wireless energy transmission unit generates wireless energy to be wirelessly transmitted, and then wirelessly transmits wireless energy, which is normally propagated radially, using a magnetic resonance method while concentrating the wireless energy at a single point. The wireless energy reception unit wirelessly receives the wireless energy using the magnetic resonance method while concentrating the wireless energy at a single point.

23 Claims, 8 Drawing Sheets

APPARATUS FOR TRANSMITTING AND RECEIVING WIRELESS ENERGY USING META-MATERIAL STRUCTURES HAVING NEGATIVE REFRACTIVE INDEX

CROSS REFERENCE TO RELATED APPLICATION

This application claims the benefit of Korean Patent Application No. 10-2010-0041050, filed on Apr. 30, 2010, entitled "Apparatus for transmitting and receiving Wireless Energy using Meta Material Structure having Negative Refractive Index," which is hereby incorporated by reference in its entirety into this application.

BACKGROUND OF THE INVENTION

1. Technical Field

The present invention relates to an apparatus for transmitting and receiving wireless energy using meta-material structures having a negative refractive index.

2. Description of the Related Art

The development of wireless communication technology is leading to a ubiquitous information environment in which anyone can exchange desired information anytime and anywhere.

Also, since most communication and information devices are dependent on batteries or supplied with power through electric codes and are then used, the utilization of the devices is limited.

In order to overcome this problem, many technologies for wirelessly transmitting electric power have been developed.

Representative examples of such technologies include microwave reception technology using microwaves, magnetic induction technology using a magnetic field, and magnetic resonance technology using energy conversion between magnetic and electric fields.

Microwave reception technology is advantageous in that it can transmit electric power over a long distance because it radiates microwaves into the air through an antenna, but has limited efficiency in the transmission of electric power because radiation loss occurring in the air is great.

Furthermore, magnetic induction technology is advantageous in that it is highly efficient at transmitting electric power because it uses magnetic energy coupling based on transmitting-side primary and receiving-side secondary coils.

However, according to magnetic induction technology, in order to transmit electric power, the transmitting-side primary coil and the receiving-side secondary coil must be placed within a short distance of about several mm.

Furthermore, magnetic induction technology is disadvantageous in that the transmission efficiency of electric power changes significantly depending on the arrangement of the transmitting-side primary coil and the receiving-side secondary coil and in that the calorific value is high.

For the above reasons, there is being developed magnetic resonance technology which is similar to magnetic induction technology, but which is configured to focus energy on a specific resonance frequency using a coil-type inductor L and a capacitor C and transmit electric power in the form of magnetic energy.

The magnetic resonance technology is advantageous in that it can transmit relatively large amounts of electric power over a distance up to several meters, but requires a high quality factor.

Here, a conventional wireless energy transmission and reception loop using the magnetic resonance technology includes a disk unit configured to include two conductor plates and a dielectric, inserted between the two conductor plates, and a ring-shaped wire unit connected to both ends of the disk unit. In order to achieve a high quality factor, the intensity of electric and magnetic fields generated by the disk unit and the wire unit must be very strong.

However, in the conventional wireless energy transmission and reception loop, in order to increase the intensity of the electric and magnetic fields, the sizes of the disk unit and the wire unit should be increased, so that the application of the conventional wireless energy transmission and reception loop to an actual wireless energy transmission and reception apparatus is inappropriate.

Furthermore, since wireless energy generated by the wireless energy transmission loop is radially propagated and then transmitted, there is loss corresponding to wireless energy which is propagated to the sides and rear of the wireless energy transmission loop.

Accordingly, there is a need for an apparatus for transmitting and receiving wireless energy, which is small enough to apply to an actual apparatus for transmitting and receiving wireless energy and which can improve the transmission distance and transmission efficiency.

SUMMARY OF THE INVENTION

Accordingly, the present invention has been made keeping in mind the above problems occurring in the prior art, and the present invention is intended to provide an apparatus for transmitting and receiving wireless energy using meta-material structures having a negative refractive index, which is small in size and which can improve the transmission distance and transmission efficiency.

According to the present invention, there is provided an apparatus for transmitting and receiving wireless energy using meta-material structures having a negative refractive index, including a wireless energy transmission unit for, when external power is applied thereto, generating wireless energy to be wirelessly transmitted, and then wirelessly transmitting wireless energy, which is normally propagated radially when the generated wireless energy is transmitted, using a magnetic resonance method while concentrating the wireless energy at a single point; and a wireless energy reception unit for wirelessly receiving the wireless energy, transmitted by the wireless energy transmission unit, using the magnetic resonance method while concentrating the wireless energy at a single point The wireless energy transmission unit may include a wireless transmission loop configured to, when external power is applied thereto, generate the wireless energy using a resonance frequency based on an inductor and a capacitor and then wirelessly transmit the generated wireless energy using the magnetic resonance method; and a wireless transmission meta-material structure placed in a wireless transmission path, and configured to have a negative refractive index so as to transmit the wireless energy, which is normally propagated radially when the generated wireless energy is transmitted, while concentrating the wireless energy at a single point.

The wireless transmission loop may include a disk unit comprising first and second conductor plates configured to correspond to each other and to be spaced apart from each other and a dielectric material inserted between the first and second conductor plates, the disk unit functioning as a capacitor so that an electric field can be induced between the first and second conductor plates; and a ring-shaped wire unit having one end connected to the first conductor plate and a remaining end connected to the second conductor plate, the ring-shaped wire unit functioning as an inductor so that a magnetic field can be induced by the electric field.

The wire unit may further include first and second terminals for connecting with the power, and, when the power is applied through the first and second terminals, current flows through the wire unit and thus the electric field is generated in the disk unit, so that the magnetic field is induced in the wire unit by the generated electric field, with the result that the wireless energy is transmitted using the magnetic resonance method.

The wireless transmission meta-material structure may be a meta-material structure which has a negative refractive index and which comprises meta cells periodically arranged and configured in a flat board form, each of the meta cells including a regular polygonal substrate and single split ring resonance patterns formed on respective surfaces of the regular polygonal substrate.

The regular polygonal substrate may have a regular hexahedron shape.

Each of the single split ring resonance patterns may include a thin metal film configured in a single split ring resonator form; and a capacitor connected between a gap of the thin metal film configured in a single split ring resonator form.

The gaps of the single split ring resonance patterns, formed on opposite faces of the regular polygonal substrate of the meta cell, may be directed in an identical direction.

The wireless transmission meta-material structure may be a meta-material structure which has a negative refractive index and which comprises meta cells periodically arranged and configured in a flat board form, each of the meta cells including a regular polygonal substrate and dual split ring resonance patterns formed on respective surfaces of the regular polygonal substrate. The regular polygonal substrate may have a regular hexahedron shape. Each of the dual split ring resonance patterns may include an external thin metal film configured in a split ring resonator form; a first capacitor connected between a gap of the external thin metal film configured in a split ring resonator form; an internal thin metal film configured in a split ring resonator form and inwardly spaced apart from the external thin metal film configured in a split ring resonator form; and a second capacitor connected between a gap of the internal thin metal film configured in a split ring resonator form.

The direction of the gap of the external thin metal film configured in a split ring resonator form may be opposite to the direction of the gap of the internal thin metal film configured in a split ring resonator form.

The gaps of the dual split ring resonance patterns, formed on opposite faces of the regular polygonal substrate of the meta cell, may be directed in an identical direction.

The wireless transmission meta-material structure may have a diameter greater than that of the wireless transmission loop.

The wireless energy reception unit may include a wireless reception loop configured to wirelessly receive the wireless energy, transmitted by the wireless energy transmission unit, using the magnetic resonance method using a resonance frequency according to an inductor L and a capacitor C; and a wireless reception meta-material structure placed in a wireless reception path and configured to have the negative refractive index and to receive the wireless energy while concentrating the wireless energy at a single point. The wireless reception loop may include a disk unit comprising first and second conductor plates configured to correspond to each other and to be spaced apart from each other and a dielectric material inserted between the first and second conductor plates, the disk unit functioning as a capacitor so that an electric field can be induced between the first and second conductor plates; and a ring-shaped wire unit having one end connected to the second conductor plates; and a ring-shaped wire unit having one end connected to the first conductor plate and a remaining end connected to the second conductor plate, the ring-shaped wire unit functioning as an inductor so that a magnetic field can be induced by the electric field.

The wire unit may further comprise first and second terminals for connecting with a load device, and, when the wireless energy is received from the wireless energy transmission unit using the magnetic resonance method, the electric field may be induced in the disk unit and thus the magnetic field is induced in the wire unit by the induced electric field, so that the induced magnetic field causes current to flow through the wire unit, with the result that the load device is supplied or charged with the wireless energy.

The wireless transmission meta-material structure may be a meta-material structure which has a negative refractive index and which comprises meta cells periodically arranged and configured in a flat board form, each of the meta cells including a regular polygonal substrate and single split ring resonance patterns formed on respective surface of the regular polygonal substrate. The regular polygonal substrate may have a regular hexahedron shape. Each of single split ring resonance patterns includes a thin metal film configured in a single split ring resonator form; and a capacitor connected between a gap of the thin metal film configured in a single split ring resonator form.

The gaps of the single split ring resonance patterns, formed on opposite faces of the regular polygonal substrate of the meta cell, may be directed in an identical direction.

The wireless transmission meta-material structure may be a meta-material structure which has a negative refractive index and which comprises meta cells periodically arranged and configured in a flat board form, each of the meta cells including a regular polygonal substrate and dual split ring resonance patterns formed on respective surfaces of the regular polygonal substrate. The regular polygonal substrate may have a regular hexahedron shape. Each of the dual split ring resonance patterns may include an external thin metal film configured in a split ring resonator form; a first capacitor connected between a gap of the external thin metal film configured in a split ring resonator form; an internal thin metal film configured in a split ring resonator form and inwardly spaced apart from the external thin metal film configured in a split ring resonator form; and a second capacitor connected metal film configured in a split ring resonator form; and a second capacitor connected between a gap of the internal thin metal film configured in a split ring resonator form.

The direction of the gap of the external thin metal film configured in a split ring resonator form may be opposite to the direction of the gap of the internal thin metal film configured in a split ring resonator form.

The gaps of the dual split ring resonance patterns, formed on opposite faces of the regular polygonal substrate of the meta cell, may be directed in an identical direction.

The wireless transmission meta-material structure may have a diameter greater than that of the wireless transmission loop.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
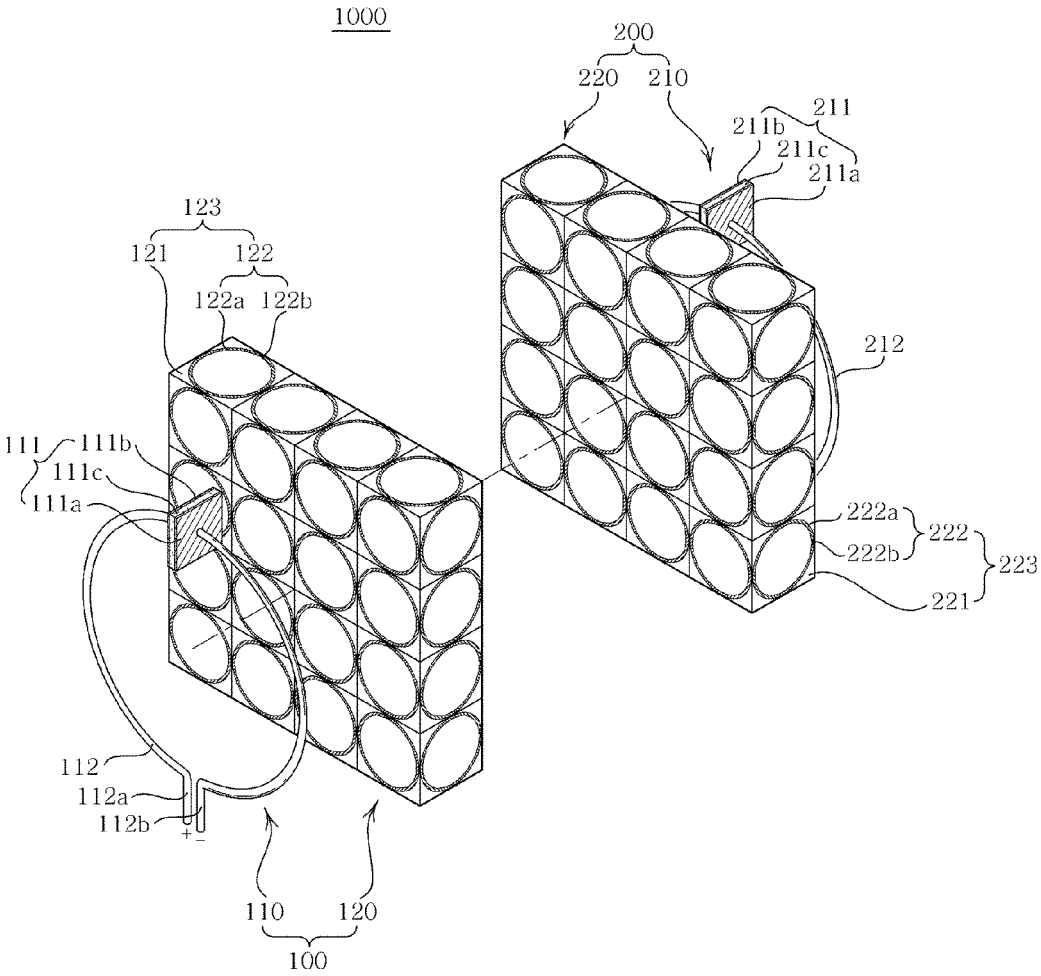
FIG. 1 is a schematic perspective view of a wireless energy transmission and reception apparatus using meta-material structures having a negative refractive index according to a first embodiment of the present invention.

If in the specification, detailed descriptions of well-known functions or configurations may unnecessarily make the gist of the present invention obscure, the detailed descriptions will be omitted.

The terms and words used in the present specification and the accompanying claims should not be limitedly interpreted as having their common meanings or those found in dictionaries, but should be interpreted as having meanings adapted to the technical spirit of the present invention on the basis of the principle that an inventor can appropriately define the concepts of terms in order to best describe his or her invention.

It should be noted that the same reference numerals are used throughout the different drawings to designate the same or similar components as often as possible.

Embodiments of the present invention will be described in detail with reference to the accompanying drawings.

Figure 2:
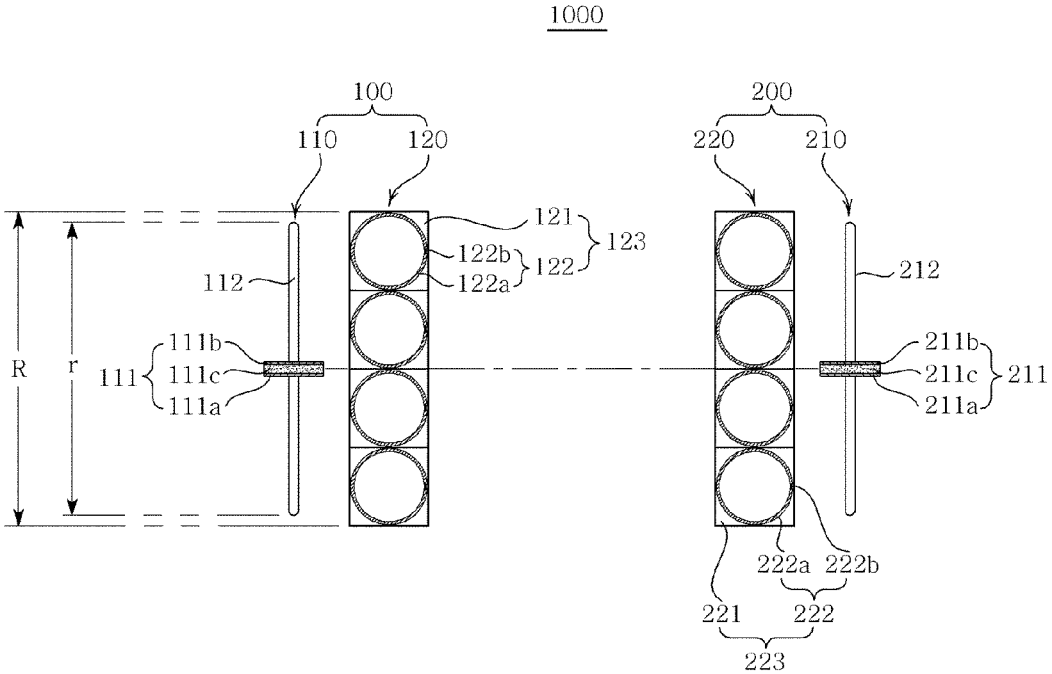
FIG. 2 is a top view of the wireless energy transmission and reception apparatus shown in FIG. 1.
Figure 3:
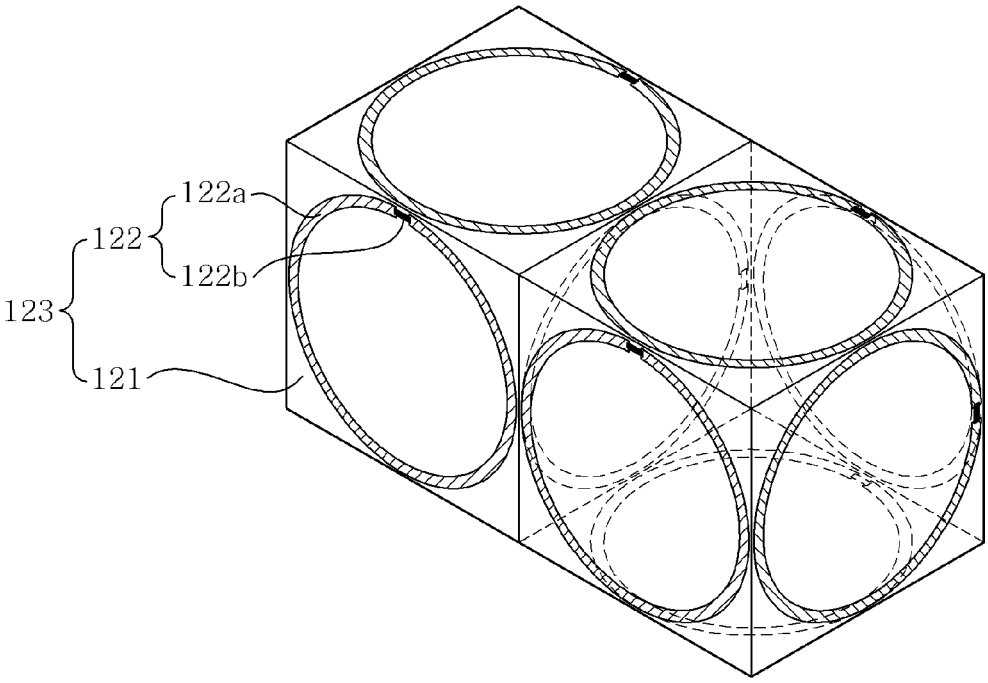
FIG. 3 is a partial detailed view showing the wireless energy transmission and reception apparatus shown in FIG. 1.

FIG. 1 is a schematic perspective view of a wireless energy transmission and reception apparatus using meta-material structures having a negative refractive index according to a first embodiment of the present invention. FIG. 2 is a top view of the wireless energy transmission and reception apparatus shown in FIG. 1. FIG. 3 is a partial detailed view showing the wireless energy transmission and reception apparatus shown in view showing the wireless energy transmission and reception apparatus shown in FIG. 1.

Referring to FIGS. 1 and 3, the wireless energy transmission and reception apparatus 1000 according to the first embodiment of the present invention includes a wireless energy transmission unit 100 and a wireless energy reception unit 200.

When external power (not shown) is applied to the wireless energy transmission unit 100, the wireless energy transmission unit 100 generates wireless energy and wirelessly transmits the generated wireless energy using a magnetic resonance method. Here, the wireless energy transmission unit 100 transmits wireless energy, which is normally propagated radially when the wireless energy is transmitted, while concentrating the wireless energy at a single point.

The wireless energy reception unit 200 wirelessly receives the wireless energy, transmitted by the wireless energy transmission unit 100, using the magnetic resonance method while concentrating the wireless energy at a single point.

First, the wireless energy transmission unit 100 will be described below. The wireless energy transmission unit 100 includes a wireless transmission loop 110 and a wireless transmission meta-material structure 120.

When external power is applied to the wireless energy transmission unit 100, the wireless transmission loop 110 generates wireless energy using a resonance frequency based on an inductor L and a capacitor C, and transmits the generated wireless energy using the magnetic resonance method.

The wireless transmission meta-material structure 120 is configured to have a negative refractive index, and is placed in a transmission path along which wireless energy is transmitted by the wireless transmission loop 110. The wireless transmission meta-material structure 120 transmits wireless energy, which is normally propagated radially when the wireless energy is wirelessly transmitted, while concentrating the wireless energy at a single point.

More particularly, the wireless transmission loop 110 includes a disk unit 111 and a ring-shaped wire unit 112 connected to both ends of the disk unit 111.

The disk unit 111 functions as a capacitor C in magnetic field-based LC resonance. The disk unit 111 includes first and second conductor plates 111*a* and 111*b* configured to correspond to each other and spaced apart from each other and a dielectric material 111*c* inserted between the first and second conductor plates 111*a* and 111*b*. When power is supplied through input and output terminals formed in the wire unit 112, an electric field is generated between the first and second conductor plates 111*a* and 111*b*.

Although the first and second conductor plates 111*a* and 111*b* generally have a circular or square shape, they are not limited thereto.

However, it is preferred that the first and second conductor plates 111*a* and 111*b* have a square shape which can acquire higher capacitance due to its area being wider than that of a circular shape for the same radius and which can be more easily fabricated, as shown in FIG. 1.

Air or an additional dielectric having specific dielectric constant $\epsilon$ may be used as the dielectric material 111*c* which is inserted between the first and second conductor plates 111*a* and 111*b*.

The intensity of the electric field generated by the disk unit 111 is determined by the size of the first and second conductor plates 111*a* and 111*b*, the distance between the first and second conductor plates 111*a* and 111*b*, and the dielectric constant $\epsilon$ of the dielectric material 111*c*.

The wire unit 112 functions as an inductor L in magnetic field-based LC resonance. The wire unit 112 is formed of a ring-shaped wire, one end of which is connected to the first conductor plate 111*a* and the other end of which is connected to the second conductor plate 111*b*.

Here, a capacitor or a variable capacitor for varying or compensating for the resonance frequency may be connected to both ends of the wire unit 112 to which the first and second conductor plates 111*a* and 111*b* are connected, instead of the disk unit 111.

Furthermore, the wire unit 112 includes first and second terminals 112*a* and 112*b*, and supplies power through the first and second terminals 112*a* and 112*b*.

When power (not shown) is supplied to the first and second terminals 112*a* and 112*b* of the wire unit 112, current flows through the wire unit 112.

When the current is applied to the disk unit 111 through the wire unit 112, an electric field is generated. The electric field causes a magnetic field to be induced from the wire unit 112.

The induced magnetic field becomes a medium which wirelessly transmits energy across the space of the wireless energy transmission and reception apparatus 1000.

The wireless transmission meta-material structure 120 has a negative refractive index n, and transfers magnetic field energy, which is generated by the wireless transmission loop 110 and is radially propagated, in a specific direction (e.g., a specific point toward the reception unit 200). The wireless transmission meta-material structure 120 is placed in a transmission path along which the wireless energy generated by the wireless transmission loop 110 is transmitted.

Accordingly, the wireless transmission unit 100 according to the present invention can transfer the magnetic field energy, generated by the wireless transmission loop 110, to the wireless energy reception unit 200 through the wireless transmission meta-material structure 120 while concentrating the magnetic field energy at a single point. Consequently, the transmission efficiency of wireless energy can be improved.

The wireless transmission meta-material structure 120 according to the first embodiment of the present invention has a meta-material structure which has a negative refractive index n and which includes unit cells 123 configured to have a meta-material structure (hereinafter referred to as 'meta cells') and periodically (e.g., in the form of an N×M matrix) arranged and configured in a flat board form. Each of the unit cells 123 includes a regular polygonal substrate 121 and single split ring resonance patterns 122 formed on respective surfaces of the regular polygonal substrate 121.

More particularly, the meta cells 123 use the regular polygonal substrates because they must have the same resonance frequency. Although the size and shape of the substrate are not limited, a regular hexahedron substrate which can be easily fabricated and which has a simple shape is preferable.

In the present invention, it is assumed that the regular polygonal substrate 121 has a regular hexahedron shape for the sake of description.

The single split ring resonance patterns 122 of the meta cell 123 are formed on all the surfaces (e.g., six faces) of the regular hexahedron-shaped substrate 121. Here, each of the single split ring resonance patterns 122 includes a thin metal film (Split Ring Resonator (SRR)) 122*a* formed in a split ring resonator shape and a capacitor 122*b* connected to the gap between the SRRs 122*a*.

Here, the gaps of the SRRs 122*a* which are formed on opposite faces of the regular hexahedron-shaped substrate 121 are directed in an identical direction, as shown in FIGS. 1 to 3.

Referring to FIG. 3, the gaps of the SRRs 122*a* formed on opposite faces of the regular hexahedron-shaped substrate 121 (i.e., the gaps of the SRRs 122*a* formed on the left and right sides of the substrate 121, the gaps of the SRRs 122*a* formed on the upper and lower sides of the substrate 121, or the gaps of the SRRs 122*a* formed in the front and rear of the substrate 121) are directed in the same direction.

Furthermore, from FIG. 3, it can be seen that one single split ring resonance pattern 122 is formed on a face where two neighboring meta cells 123 are brought into contact with each other.

As described above, the meta cell 123 forms an LC resonance structure including the SRR 122*a* and the capacitor 122*b*. The resonance frequency can be adjusted by the shape and size of the SRR 122*a* or the value of the capacitor 122*b*.

Although the shape and size of the SRR 122*a* is not limited, a square or circular SRR is chiefly used as the SRR 122*a*.

Here, since the square SRR has a longer length than the circular SRR for the same area and thus has an increased inductance component, the square SRR is advantageous in that it can be resonated at a lower frequency.

In contrast, the circular SRR is advantageous in that it has a lower loss than the square SRR because the flow of current caused by a magnetic field is smooth.

Accordingly, the square SRR, the circular SRR, or an SRR having a specific shape is selectively used according to design purposes.

A meta-material structure 120 having a negative refractive index n can be realized by periodically arranging the meta cells 123.

In the first embodiment of the present invention, the wireless transmission meta-material structure 120 includes a total of 16 meta cells 123 in the form of a 4×4 matrix, as shown in FIGS. 1 and 2.

It is preferred that the diameter R of the wireless transmission meta-material structure 120 be greater than the diameter r of the wireless transmission loop 110 so that energy, which is generated by the wireless transmission loop 110 and is normally propagated radially, can all be accommodated (refer to FIG. 2).

Meanwhile, the wireless energy reception unit 200 will be described below. The wireless energy reception unit 200 includes a wireless reception loop 210 and a wireless reception meta-material structure 220.

The wireless reception loop 210 receives the wireless energy, transmitted by the wireless energy transmission unit 100, using the magnetic resonance method using the resonance frequency based on an inductor L and a capacitor C.

The wireless reception meta-material structure 220 is configured to have a negative refractive index, and is placed in a reception path along which the wireless energy transmitted by the transmission unit 100 is received. The wireless reception meta-material structure 220 concentrates the wireless energy at a single point.

Here, the wireless reception loop 210 has the same elements as the wireless transmission loop 110, and the wireless reception meta-material structure 220 has the same elements as the wireless transmission meta-material structure 120. Accordingly, detailed descriptions of the same elements will be omitted here.

In the wireless energy transmission unit 100, power is connected to the first and second terminals 112*a* and 112*b* formed in the wire unit 112 of the wireless transmission loop 110, whereas in the wireless energy reception unit 200, a load device (not shown), such as an electric power consumption device or a charger, is connected to first and second terminals (not shown) formed in the wire unit 212 of the wireless reception loop 210. Here, the load device (not shown) consumes or performs charging using magnetic field energy (e.g., wireless energy) received from the wireless transmission unit 100.

That is, contrary to the process in which the wireless energy transmission unit 100 transmits wireless energy, in the wireless energy reception unit 200, in order to receive the magnetic field energy transmitted by the wireless transmission unit 100, the wireless reception meta-material structure 220 receives the magnetic field energy and the magnetic field causes current to flow through the wireless reception loop 210. Accordingly, the load device can be supplied or charged with electric power.

Figure 4:
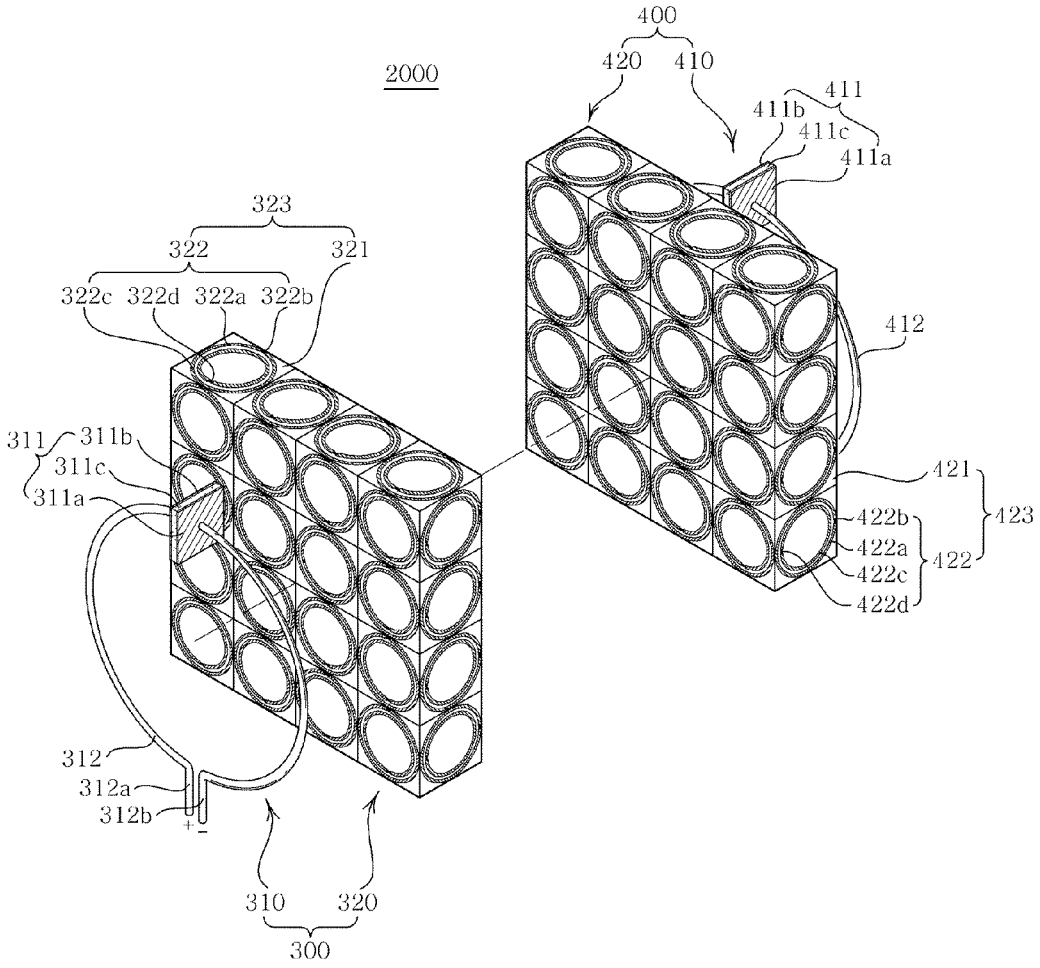
FIG. 4 is a schematic perspective view showing a wireless energy transmission and reception apparatus using meta-material structures having a negative refractive index according to a second embodiment of the present invention.
Figure 5:
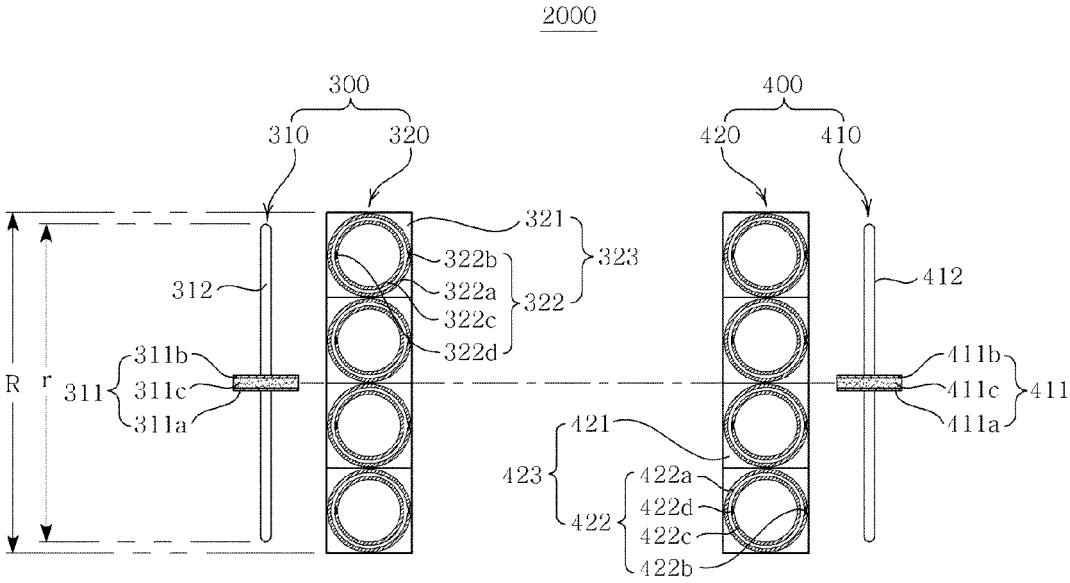
FIG. 5 is a top view of the wireless energy transmission and reception apparatus shown in FIG. 4.

FIG. 4 is a schematic perspective view showing a wireless energy transmission and reception apparatus using meta-material structures having a negative refractive index according to a second embodiment of the present invention. FIG. 5 is a top view of the wireless energy transmission and reception apparatus shown in FIG. 4.

Referring to FIGS. 4 and 5, the wireless energy transmission and reception apparatus 2000 using meta-material structures having a negative refractive index according to the second embodiment of the present invention includes the same elements as the wireless energy transmission and reception apparatus 1000 using meta-material structures having a negative refractive index according to the first embodiment of the present invention, with the exception of the wireless transmission and reception meta-material structures 320 and 420. Accordingly, descriptions of elements which are the same have been omitted here. The wireless transmission and reception meta-material structure 320 or 420 according to the second embodiment of the present invention has a meta-material structure, which has a negative refractive index n and which includes unit cells 323 and 423 configured to have a meta-material structure (hereinafter referred to as 'meta cells') and meta-material structure (hereinafter referred to as 'meta cells') and periodically (e.g., in the form of an N×M matrix) arranged and configured in a flat board form. Each of the unit cells 323 and 423 includes a regular polygonal substrate 321 or 421 and dual split ring resonance patterns 322 or 422 formed on respective surfaces of the regular polygonal substrate 321 or 421.

Since the regular polygonal substrates 321 and 421 are respectively the same as the substrates 121 and 221 described above in connection with the first embodiment of the present invention, detailed description thereof will be omitted here.

The dual split ring resonance patterns 322 or 422 of the meta cell 324 or 423 are formed on all the surfaces (e.g., six faces) of the regular hexahedron-shaped substrate 321 or 421. Here, each of the dual split ring resonance patterns 322 and 422 includes an external thin metal film (external SRR) 322*a* or 422*a* configured in a split ring resonator form, a first capacitor 322*b* or 422*b* connected to the gap between the external SRRs 322*a* and 422*a*, an internal thin metal film (internal SRR) 322*c* or 422*c* configured in a split ring resonator form, and a second capacitor 322*d* or 422*d* connected to the gap between the internal SRRs 322*c* and 422*c*.

Here, the internal SRR 322*c* or 422*c* is formed so that it is inwardly spaced apart from the external SRR 322*a* or 422*a* and the gap of the external SRR 322*a* or 422*a* and the gap of the internal SRR 322*c* or 422*c* are formed in opposite directions (180°).

Furthermore, the gaps of the external and internal SRRs 322*a* and 322*c* or 422*a* and 422*c* of the dual split ring resonance pattern 322 or 422, which are formed on the face where they face each other in the regular hexahedron-shaped substrate 321 or 421, are directed in the same direction as was described above in conjunction with the first embodiment of the present invention.

The dual split ring resonance pattern 322 or 422 according to the second embodiment of the present invention can have a higher quality factor Q because of mutual coupling attributable to mutual inductance and mutual capacitance between the external SRR 322*a* or 422*a* and the internal SRR 322*c* or 422*c* as compared with the single split ring resonance pattern 122 or 222 according to the first embodiment of the present invention.

Figure 6:
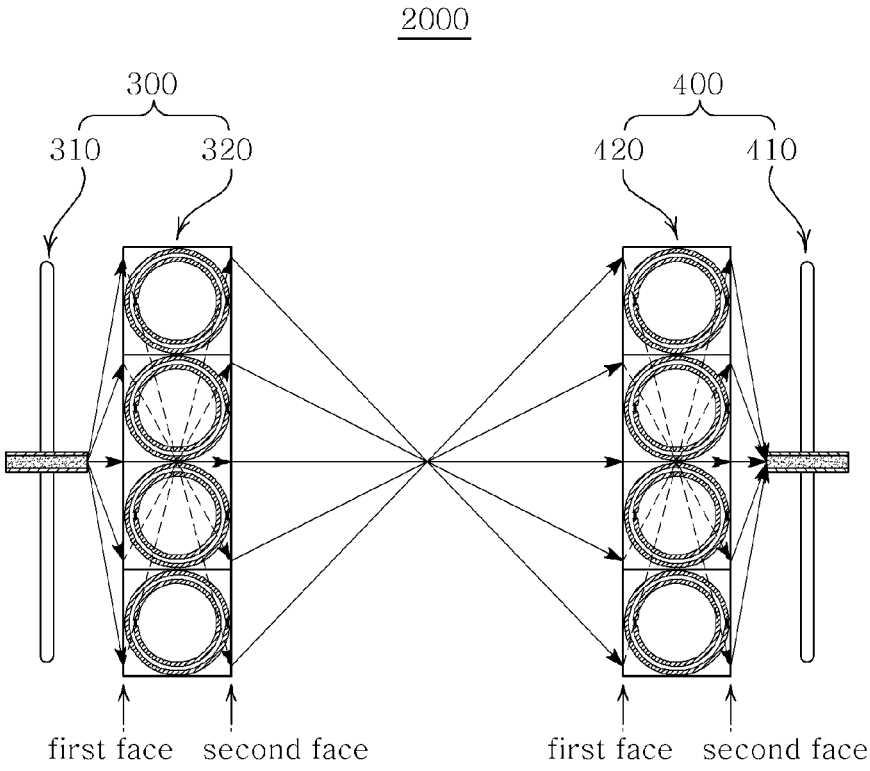
FIG. 6 is a diagram illustrating the flow of the transmission of wireless energy according to the second embodiment of the present invention.

FIG. 6 is a diagram illustrating the flow of the transmission of wireless energy according to the second embodiment of the present invention.

Although in FIG. 6, the flow of the transmission of wireless energy is shown in relation to the wireless energy transmission and reception apparatus 2000 using the wireless transmission and reception meta-material structures 320 and 420 according to the second embodiment of the present invention, a transmission flow similar to that of FIG. 6 can be obtained in the wireless energy transmission and reception apparatus 1000 using the wireless transmission and reception meta-material structures 120 or 220 according to the first embodiment of the present invention.

Referring to FIG. 6, in the wireless transmission unit 300, when wireless energy generated by the transmission loop 310 and radially propagated reaches the first face of the wireless transmission meta-material structure 320 having a negative refractive index, the wireless energy is refracted from the first face as indicated by the dotted lines without being externally propagated and lost because of the negative refractive index and then arrives at the second face of the wireless transmission meta-material structure 320. Next, the wireless energy is negatively refracted from the second face because of the negative refractive index of the wireless transmission meta-material structure 320 and then concentrated on a specific point.

Furthermore, in the wireless reception unit 400, when the wireless energy focused as described above reaches the first face of the wireless reception meta-material structure 420 having a negative refractive index, the wireless energy is refracted from the first face as indicated by the dotted lines without being externally propagated and lost because of the negative refractive index and then arrives at the second face of the wireless reception meta-material structure 420. Next, the wireless energy is negatively refracted from the second face because of the negative refractive index of the wireless reception meta-material structure 420 and then concentrated on the wireless reception loop 410.

Figure 7:
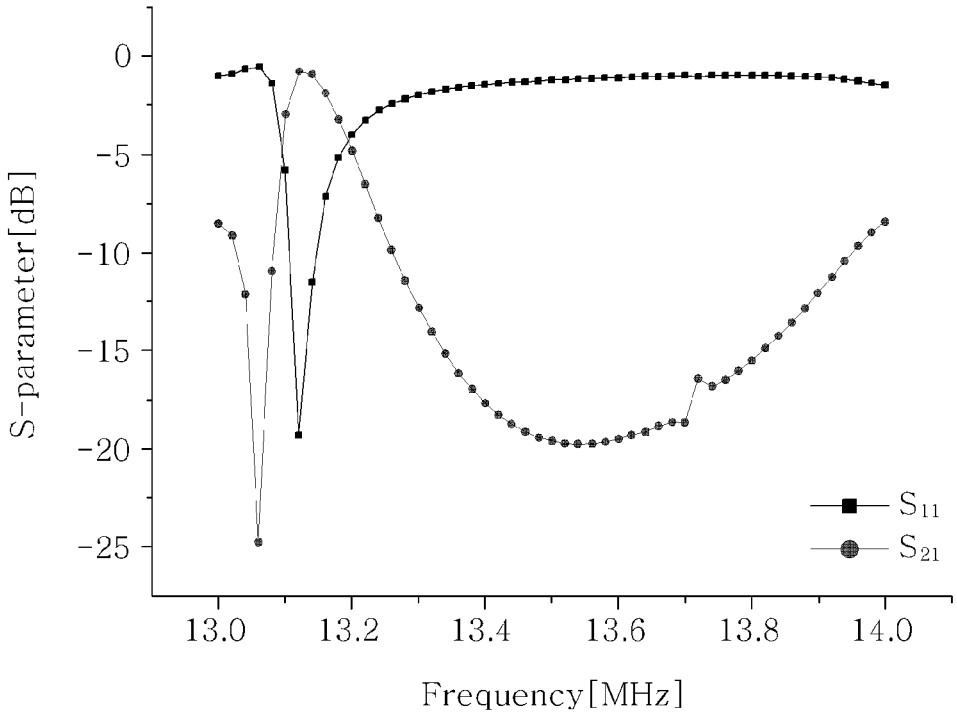
FIG. 7 is a simulation graph showing an S-parameter curve depending on operating frequencies in the wireless energy transmission and reception apparatus using meta-material structures having a negative refractive index according to the first embodiment of the present invention.

As described above, the wireless transmission and reception meta-material structures 320 and 420 having a negative refractive index function to prevent wireless energy from being externally propagated and lost and transmit and receive wireless energy while concentrating the wireless energy at a single point. Accordingly, transmission characteristics, such as transmission efficiency and the transmission distance, can be improved FIG. 7 is a simulation graph showing an S-parameter curve depending on operating frequencies in the wireless energy transmission and reception apparatus using the meta-material structures having a negative refractive index according to the first embodiment of the present invention.

Here, the wireless transmission and reception loops 110 and 210 and the wireless transmission and reception meta-material structures 120 and 220 used in the present simulation were designed to have the same size and structure. The distance (i.e., the transmission distance) between the wireless energy transmission unit 100 and the wireless energy reception unit 200 was approximately 500.

More particularly, the diameter r of the wireless transmission and reception loops 110 or 210 were 330 mm.

Furthermore, the wireless transmission and reception meta-material structure 120 or 220 used herein included the wireless transmission meta-material structure 120 or 220 in which the meta cells 123 or 223 each having a regular hexahedron shape, one side of which is 12, were arranged in the form of a 4×4 matrix. Accordingly, the diameter R of the wireless transmission and reception meta-material structure 120 or 220 was 480.

Furthermore, the distance between the wireless transmission and reception loop 110 or 210 and the wireless transmission and reception meta-material structure 120 or 220 was approximately 100.

Meanwhile, the dielectric constant ϵ of the substrate 121 or 221 of the meta cell 123 or 223 was 10.2, the diameter of the single SRR 122*a* or 222*a* of the single split ring resonance pattern 122 or 222 formed in the substrate 121 or 221 was 118, and the capacitance of the capacitor 122*b* or 222*b* connected to the gap between the single SRRs 122*a* or 222*a* was 10 nF.

When the wireless transmission and reception meta-material structures 120 and 220 described above are used, the simulation graph showing an S-parameter curve depending on operating frequencies shown in FIG. 7 can be obtained.

From FIG. 7, it can be seen that the wireless energy transmission and reception apparatus 1000 using meta-material structures having a negative refractive index according to the first embodiment of the present invention 1000 has a resonance frequency of about 13.12 Hz (the lowest point in the curve $S_{11}$) and a transmission gain of −0.795 dB (the curve $S_{21}$) at the resonance frequency of about 13.12 Hz, for a transmission distance of 500.

When electric power is supplied at the above resonance frequency, transmission efficiency in the transmission distance 500 is calculated using the following Equation 1:

$$\text{Transmission efficiency (\%)} = 10 \log [\text{transmission gain}] \quad (1)$$

When the transmission gain is substituted into Equation 1, a transmission efficiency of about 83.3% can be obtained.

Figure 8:
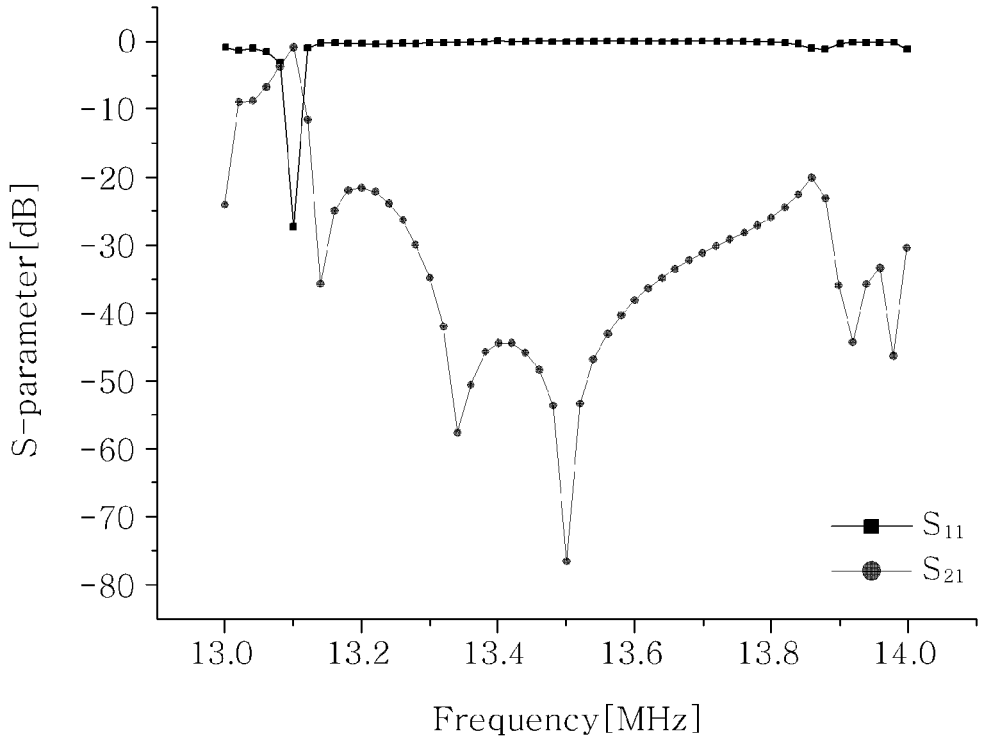
FIG. 8 is a simulation graph showing an S-parameter curve depending on operating frequencies in the wireless energy transmission and reception apparatus using meta-material structures having a negative refractive index according to the second embodiment of the present invention.

FIG. 8 is a simulation graph showing an S-parameter curve depending on operating frequencies in the wireless energy transmission and reception apparatus using meta-material structures having a negative refractive index according to the second embodiment of the present invention.

The wireless energy transmission and reception apparatus 2000 used in the present simulation is the same as the wireless energy transmission and reception apparatus 1000 used in the simulation of FIG. 7, with the exception of the structure of the meta cells 324, 423. The dielectric constant ϵ of the substrate 321 or 421 of the meta cell 324 or 423 was 10.2, the diameter of the external SRR 322*a* or 422*a* of the dual split ring resonance pattern 322 or 422 formed in the substrate 321 or 421 was 118, the diameter of the internal SRR 322*c* or 422*c* was 102 , and the capacitance of each of the first and second capacitors 322*b* and 322*d* or 422*b* and 422*d* connected to the gap between the external and internal SRRs 322*a* and 322*c* or 422*a* and 422*c* was 10 nF.

From FIG. 8, it can be seen that the wireless energy transmission and reception apparatus 2000 using meta-material structures having a negative refractive index according to the second embodiment of the present invention has a resonance frequency of about 13.10 Hz (the lowest point in the curve $S_{11}$) and a transmission gain of −0.842 dB (the curve $S_{21}$) at the resonance frequency of about 13.10 Hz, for a transmission distance of 500.

When the transmission gain is substituted into Equation 1, a transmission efficiency of about 82.4% can be obtained.

As described above, in the wireless energy transmission and reception apparatus 1000, 2000, when wireless energy is transmitted, a high transmission efficiency can be acquired using the wireless transmission and reception meta-material structures 320 and 420 using the dual split ring resonance patterns 322 and 422 as compared with using the wireless transmission and reception meta-material structures 120 and 220 using the single split ring resonance patterns 122 and 222.

Figure 9:
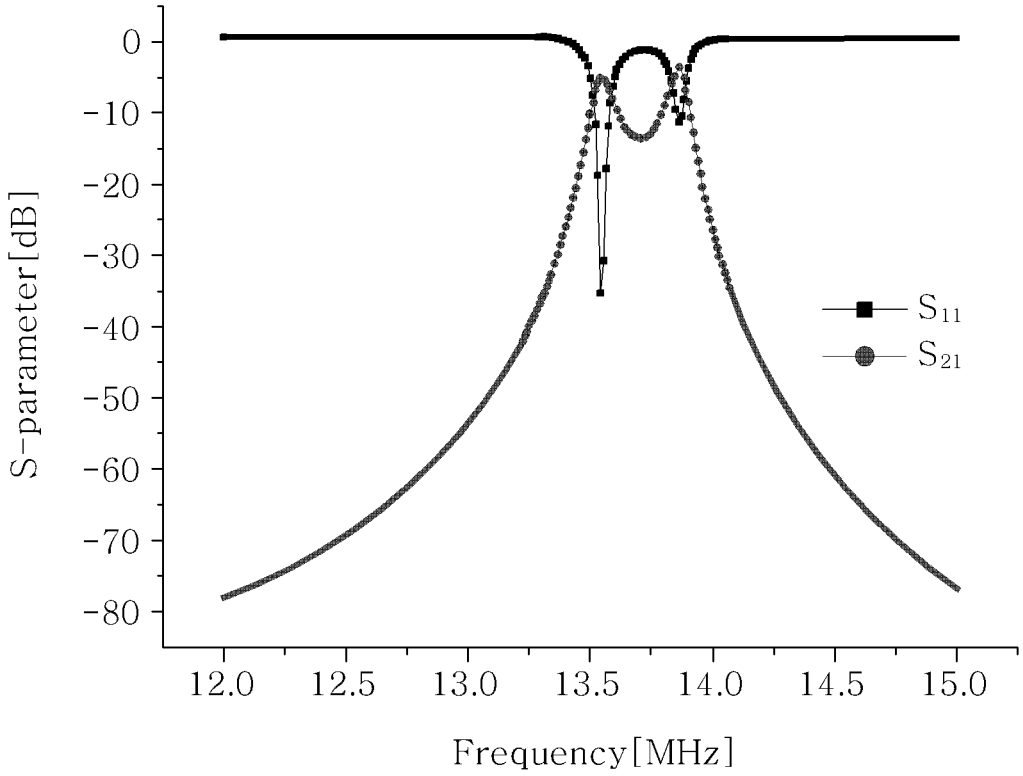
FIG.9 Prior art
FIG. 9 is a simulation graph showing an S-parameter curve depending on operating frequencies in a conventional wireless energy transmission and reception apparatus.

FIG. 9 is a simulation graph showing an S-parameter curve depending on operating frequencies in a conventional wireless energy transmission and reception apparatus. The wireless energy transmission and reception apparatus used in the present simulation included only the wireless transmission and reception loops 110 and 210 or 310 and 410 without the wireless transmission and reception meta-material structures 120 and 220 or 320 and 420 of the energy transmission and reception apparatus 1000 or 2000 according to the first and second embodiments.

From FIG. 9, it can be seen that the conventional wireless energy transmission and reception apparatus has a resonance frequency of about 13.56 Hz (the lowest point in the curve $S_{11}$) and a transmission gain of −3.569 dB (the curve $S_{21}$) at the resonance frequency of about 13.56 Hz, for a transmission distance of 500.

When the transmission gain is substituted into Equation 1, a transmission efficiency of about 44% can be obtained.

It can be seen from the above that when the wireless transmission and reception meta-material structures 120 and 220 or 320 and 420 according to the first and second embodiments of the present invention are used, transmission efficiency is further improved and the resonance frequency is further lowered under the same conditions.

Furthermore, a further reduction in the resonance frequency means that the size of the wireless energy transmission and reception apparatuses 1000 and 2000 according to the present invention can be further reduced for the same resonance frequency.

As described above, in the wireless energy transmission and reception apparatus 1000 or 2000 using meta-material structures having a negative refractive index according or 2000 using meta-material structures having a negative refractive index according to the first and second embodiments of the present invention, the wireless transmission and reception meta-material structures 120 and 220 or 320 and 420 having a negative refractive index are placed in the transmission and reception paths of the wireless transmission and reception loops 110 and 210 or 310 and 410. Accordingly, since wireless energy can be transferred while the wireless energy is concentrated at a single point, transmission characteristics can be improved.

As described above, the wireless energy transmission and reception apparatuses according to the embodiments of the present invention are advantageous in that the size is reduced and the transmission distance and transmission efficiency are improved for the same amount of electric power because the meta-material structures having a negative refractive index are used.

Furthermore, the wireless energy transmission and reception apparatuses according to the present invention are advantageous in that they have a high quality factor because the meta-material structure having a negative refractive index can be easily added without making additional changes to the conventional construction.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for transmitting and receiving wireless energy using meta-material structures having a negative refractive index, comprising:

a wireless energy transmission unit for, when external power is applied thereto, generating wireless energy to be wirelessly transmitted, and then wirelessly transmitting wireless energy, which is normally propagated radially when the generated wireless energy is transmitted, using a magnetic resonance method while concentrating the wireless energy at a single point; and a wireless energy reception unit for wirelessly receiving the wireless energy, transmitted by the wireless energy transmission unit, using the magnetic resonance method while concentrating the wireless energy at a single point, wherein the wireless energy transmission unit comprises:

a wireless transmission loop configured to, when external power is applied thereto, generate the wireless energy using a resonance frequency based on an inductor and a capacitor and then wirelessly transmit the generated wireless energy using the magnetic resonance method; and a wireless transmission meta-material structure placed in a wireless transmission path, and configured to have a negative refractive index so as to transmit the wireless energy, which is normally propagated radially when the generated wireless energy is transmitted, while concentrating the wireless energy at a single point, wherein the wireless transmission meta-material structure is a meta-material structure which has a negative refractive index and which comprises meta cells periodically arranged and configured in a flat board form, each of the meta cells including a regular polygonal substrate and single split ring resonance patterns formed on respective surfaces of the regular polygonal substrate, wherein gaps of the single split ring resonance patterns, formed on opposite faces of the regular polygonal substrate of the meta cell, are directed in an identical direction.

2. The apparatus as set forth in claim 1, wherein the wireless transmission loop comprises:

a disk unit comprising first and second conductor plates configured to correspond to each other and to be spaced apart from each other and a dielectric material inserted between the first and second conductor plates, the disk unit functioning as a capacitor so that an electric field can be induced between the first and second conductor plates; and a ring-shaped wire unit having one end connected to the first conductor plate and a remaining end connected to the second conductor plate, the ring-shaped wire unit functioning as an inductor so that a magnetic field can be induced by the electric field.

3. The apparatus as set forth in claim 2, wherein:

the ring-shaped wire unit further comprises first and second terminals for connecting with the power, and when the power is applied through the first and second terminals, current flows through the wire unit and thus the electric field is generated in the disk unit, so that the magnetic field is induced in the wire unit by the generated electric field, with the result that the wireless energy is transmitted using the magnetic resonance method.

4. The apparatus as set forth in claim 1 , wherein the regular polygonal substrate has a regular hexahedron shape.

5. The apparatus as set forth in claim 1 , wherein each of the single split ring resonance patterns comprises:

a thin metal film configured in a single split ring resonator form; and a capacitor connected between a gap of the thin metal film configured in a single split ring resonator form.

6. The apparatus as set forth in claim 1, wherein the wireless transmission meta-material structure has a diameter greater than that of the wireless transmission loop.

7. The apparatus as set forth in claim 1, wherein the wireless energy reception unit comprises:

a wireless reception loop configured to wirelessly receive the wireless energy, transmitted by the wireless energy transmission unit, using the magnetic resonance method using a resonance frequency according to an inductor L and a capacitor C; and a wireless reception meta-material structure placed in a wireless reception path and configured to have the negative refractive index and to receive the wireless energy while concentrating the wireless energy at a single point.

8. The apparatus as set forth in claim 7, wherein the wireless reception loop comprises:

a disk unit comprising first and second conductor plates configured to correspond to each other and to be spaced apart from each other and a dielectric material inserted between the first and second conductor plates, the disk unit functioning as a capacitor so that an electric field can be induced between the first and second conductor plates; and a ring-shaped wire unit having one end connected to the first conductor plate and a remaining end connected to the second conductor plate, the ring-shaped wire unit functioning as an inductor so that a magnetic field can be induced by the electric field.

9. The apparatus as set forth in claim 7, wherein:

the wire unit further comprises first and second terminals for connecting with a load device, and when the wireless energy is received from the wireless energy transmission unit using the magnetic resonance method, the electric field is induced in the disk unit and thus the magnetic field is induced in the wire unit by the induced electric field, so that the induced magnetic field causes current to flow through the wire unit, with the result that the load device is supplied or charged with the wireless energy. is supplied or charged with the wireless energy.

10. The apparatus as set forth in claim 7, wherein the wireless transmission meta-material structure is a meta-material structure which has a negative refractive index and which comprises meta cells periodically arranged and configured in a flat board form, each of the meta cells including a regular polygonal substrate and single split ring resonance patterns formed on respective surface of the regular polygonal substrate.

11. The apparatus as set forth in claim 10, wherein the regular polygonal substrate has a regular hexahedron shape.

12. The apparatus as set forth in claim 10, wherein each of the single split ring resonance patterns comprises:

a thin metal film configured in a single split ring resonator form; and a capacitor connected between a gap of the thin metal film configured in a single split ring resonator form.

13. The apparatus as set forth in claim 10, wherein gaps of the single split ring resonance patterns, formed on opposite faces of the regular polygonal substrate of the meta cell, are directed in an identical direction.

14. The apparatus as set forth in claim 7, wherein the wireless transmission meta-material structure has a diameter greater than that of the wireless transmission loop.

15. An apparatus for transmitting and receiving wireless energy using meta-material structures having a negative refractive index, comprising:

a wireless energy transmission unit for, when external power is applied thereto, generating wireless energy to be wirelessly transmitted, and then wirelessly transmitting wireless energy, which is normally propagated radially when the generated wireless energy is transmitted, using a magnetic resonance method while concentrating the wireless energy at a single point; and a wireless energy reception unit for wirelessly receiving the wireless energy, transmitted by the wireless energy transmission unit, using the magnetic resonance method while concentrating the wireless energy at a single point, wherein the wireless energy transmission unit comprises:

a wireless transmission loop configured to, when external power is applied thereto, generate the wireless energy using a resonance frequency based on an inductor and a capacitor and then wirelessly transmit the generated wireless energy using the magnetic resonance method; and a wireless transmission meta-material structure placed in a wireless transmission path, and configured to have a negative refractive index so as to transmit the wireless energy, which is normally propagated radially when the generated wireless energy is transmitted, while concentrating the wireless energy at a single point, wherein the wireless transmission meta-material structure is a meta-material structure which has a negative refractive index and which comprises meta cells periodically arranged and configured in a flat board form, each of the meta cells including a regular polygonal substrate and dual split ring resonance patterns formed on respective surfaces of the regular polygonal substrate, wherein gaps of the dual split ring resonance patterns, formed on opposite faces of the regular polygonal substrate of the meta cell, are directed in an identical direction.

16. The apparatus as set forth in claim 15, wherein the regular polygonal substrate has a regular hexahedron shape.

17. The apparatus as set forth in claim 15, wherein each of the dual split ring resonance patterns comprises:

an external thin metal film configured in a split ring resonator form;

a first capacitor connected between a gap of the external thin metal film configured in a split ring resonator form;

an internal thin metal film configured in a split ring resonator form and inwardly spaced apart from the external thin metal film configured in a split ring resonator form; and a second capacitor connected between a gap of the internal thin metal film configured in a split ring resonator form.

18. The apparatus as set forth in claim 17, wherein a direction of the gap of the external thin metal film configured in a split ring resonator form is opposite to a direction of the gap of the internal thin metal film configured in a split ring resonator form.

19. The apparatus as set forth in claim 15, wherein the wireless transmission meta-material structure is a meta-material structure which has a negative refractive index and which comprises meta cells periodically arranged and configured in a flat board form, each of the meta cells including a regular polygonal substrate and dual split ring resonance patterns formed on respective surfaces of the regular polygonal substrate.

20. The apparatus as set forth in claim 19, wherein the regular polygonal substrate has a regular hexahedron shape.

21. The apparatus as set forth in claim 19, wherein each of the dual split ring resonance patterns comprises:

an external thin metal film configured in a split ring resonator form;

a first capacitor connected between a gap of the external thin metal film configured in a split ring resonator form;

an internal thin metal film configured in a split ring resonator form and inwardly spaced apart from the external thin metal film configured in a split ring resonator form; and a second capacitor connected between a gap of the internal thin metal film configured in a split ring resonator form.

22. The apparatus as set forth in claim 21, wherein a direction of the gap of the external thin metal film configured in a split ring resonator form is opposite to a direction of the gap of the internal thin metal film configured in a split ring resonator form.

23. The apparatus as set forth in claim 21, wherein gaps of the dual split ring resonance patterns, formed on opposite faces of the regular polygonal substrate of the meta cell, are directed in an identical direction.

* * * * *